US009202394B2

(12) United States Patent
Meersman

(10) Patent No.: US 9,202,394 B2
(45) Date of Patent: Dec. 1, 2015

(54) METHOD AND DEVICE FOR SHADING IN A DISPLAY SYSTEM

(75) Inventor: Karim Meersman, Kortemark (BE)

(73) Assignee: BARCO N.V., Kortruk (BE)

( * ) Notice: Subject to any disclaimer, the term of this patent is extended or adjusted under 35 U.S.C. 154(b) by 0 days.

(21) Appl. No.: 12/664,915

(22) PCT Filed: Jun. 18, 2008

(86) PCT No.: PCT/EP2008/057736

§ 371 (c)(1),
(2), (4) Date: Dec. 16, 2009

(87) PCT Pub. No.: WO2008/155366

PCT Pub. Date: Dec. 24, 2008

(65) Prior Publication Data

US 2010/0182769 A1 Jul. 22, 2010

(30) Foreign Application Priority Data

Jun. 18, 2007 (GB) ..... 0711632.0

(51) Int. Cl.

| | |
|---|---|
| ***F21V 1/00*** | (2006.01) |
| ***G09F 9/33*** | (2006.01) |
| ***F21V 7/00*** | (2006.01) |
| ***G09F 13/22*** | (2006.01) |
| *F21Y 105/00* | (2006.01) |

(52) U.S. Cl.

CPC ..... *G09F 9/33* (2013.01); *F21V 7/0083* (2013.01); *G09F 13/22* (2013.01); *F21Y 2105/001* (2013.01)

(58) Field of Classification Search

CPC ..... F21V 7/0083; F21Y 2105/001–2105/003
USPC ..... 362/217.03
See application file for complete search history.

(56) References Cited

U.S. PATENT DOCUMENTS

| | | | | |
|---|---|---|---|---|
| 6,169,632 | B1 | 1/2001 | Kurtenbach et al. | |
| 6,969,181 | B1 * | 11/2005 | Bailey et al. | 362/364 |
| 2005/0062396 | A1 | 3/2005 | Yang | |
| 2006/0268556 | A1 * | 11/2006 | Hsieh | 362/347 |
| 2007/0273984 | A1 * | 11/2007 | Pao et al. | 359/726 |

FOREIGN PATENT DOCUMENTS

| | | |
|---|---|---|
| JP | 11-52878 | 2/1999 |
| JP | 11-52878 A | 2/1999 |
| JP | 2002-368290 | 12/2002 |
| JP | 2002-368290 A | 12/2002 |
| JP | 2004-184669 | 7/2004 |
| JP | 2004-184669 A | 7/2004 |

OTHER PUBLICATIONS

International Preliminary Report on Patentability in PCT/EP2008/057736, Dec. 22, 2009.
Second Office action from the State Intellectual Property Office of the P.R.C. (SIPO) in Chinese application No. 200880020546.6, Dec. 31, 2012.

(Continued)

*Primary Examiner* — Sean Gramling
(74) *Attorney, Agent, or Firm* — Bacon & Thomas, PLLC

(57) ABSTRACT

The present invention relates to a shading device for use with a display system. The shading device comprising fixing means (102) for fixing onto the display system.

16 Claims, 3 Drawing Sheets

(56) References Cited

OTHER PUBLICATIONS

Examination Report of China IP Office regarding CN 2008-80020546.6, Feb. 16, 2012.

Chinese Office Action dated Apr. 30, 2014, for CN 200880020546.6, and English translation thereof.

* cited by examiner

METHOD AND DEVICE FOR SHADING IN A DISPLAY SYSTEM

TECHNICAL FIELD OF THE INVENTION

The present invention relates to systems, devices and methods for displaying information. More particularly, the present invention relates to systems, devices and methods for shading in display systems, and to display systems or devices using such shading systems.

BACKGROUND OF THE INVENTION

Modern light emitting diode (LED) displays increasingly use optical systems at the front of the display in order to increase optical performance characteristics, such as contrast ratio, brightness, viewing angle, colour compound.

One of the most frequently used devices for increased optical performance, is the shading device. A shader for LED displays generally consists of a grid which fits over the LEDs and fills up the space between the LEDs. The shading device can have several optical features like louvers for avoidance of angled direct light hitting the front of the LED. Other optical features embedded in the shading device are light-traps which consist of cavities which are dimensioned in such a way that incoming light is caught in these cavities, yielding better contrast for the display.

One of the main problems with shaders is the way to attach them to the LED printed circuit board (PCB). Usually the shader is glued to the LED PCB, leading to difficulty to remove if any repair work needs to be done to the LEDs or the LED PCB. Ideal is a removable shader. A removable shading device is convenient however very difficult to manufacture. Major problem is that the shading device must be firmly connected to the front of the LED PCB. This is often done by a number of extending clips which are standing orthogonally on the back of the shading device. These clips are very vulnerable to breaking and moreover with very small pitch (e.g. 4 mm) clips are almost impossible to add to the shader mechanics. Because of the difficulty to add clips, only a few of them are usually added which results in very bad and irregular mechanical fitting of the shading device to the LED PCB. This irregular fitting results in uneven mechanical fitting of the shader, overall on the front of the display, which finally causes a non uniform display. So with this technique a few hard connections (clips) hold the shader to the LED PCB.

SUMMARY OF THE INVENTION

It is an object of the present invention to provide good shading devices, display systems for use with such shading devices and methods for installing shading devices on display systems. It is an advantage of some embodiments of the present invention that a method is provided by which a shading device, e.g. comprising a number of shader elements or louvers, may be mechanically connected to a display system, e.g. a LED PCB of a LED display, by a plurality of soft connections instead of a few hard connections. It is an advantage of embodiments of the present invention that soft connections may be established by mechanically locking the shading device, e.g. shader structure, to the display system, e.g. LED package. Because of the omnipresence of the LEDs lots of these connections can be made.

The above object is obtained by a shading device, a corresponding display system and components thereof and a method for manufacturing according to the present invention. Particular embodiments will be as described below.

In one aspect, the present invention provides a method to use the light source unit, e.g. light source package or in case of a LED display the LED package, as a means to fix, e.g. hook, the shading device, e.g. shading grid, onto. The light source unit, e.g. light source package or in case of a LED display the LED package, has a fixing element, e.g. a mechanical fixing element such as a cavity or slot along side walls of the packaging, to which the shading device can connect, e.g. mechanically connect.

It is furthermore an advantage of embodiments of the present invention that by providing simple mechanical provisions or fixing means to the shader, the shader can simply click onto the LED package. By making it a soft click, the mechanical fix per light source unit, e.g. LED package, may be weak, in a way that damage or hard pulling to the light source unit, e.g. LED package, is avoided.

It is an advantage of embodiments of the present invention that, by providing a plurality of connections, e.g. lots of weak mechanical connections, distributed evenly over the display system viewing plane, e.g. distributed evenly over the LED PCB, a multitude of mechanical soft fixes can be achieved, yielding a firm shader fix. The shading device may completely follow and match onto the underlying surface. The shading device fixation design can be very simple, because only simple fixing means, e.g. mechanical fixing means, need to be provided in the structure of the shading device. It is also an advantage of embodiments of the present invention that the shading device can easily be removed and re-applied.

It is an advantage of embodiments according to the present invention that the fixing of the shading device to the display system can be firm.

It is an advantage of embodiments according to the present invention that the fixing elements may be connected to the display system at a plurality of points to the display system, e.g. substantially uniformly spread over the display system resulting in a uniform fixing to the display system. The load on the display system in this way may be spread over the display system, resulting in little or no deformation forces from the shading device on the display, system.

The present invention will be described with reference to certain drawings but the invention is not limited thereto but only by the claims. The drawings described are only schematic and are non-limiting. In the drawings, the size of some of the elements may be exaggerated and not drawn on scale for illustrative purposes. The dimensions and the relative dimensions do not correspond to actual reductions to practice of the invention.

BRIEF DESCRIPTION OF THE DRAWINGS

FIG. 2(*b*) illustrates a vertical cross-sectional view of the shading device;

In the different figures, the same reference signs refer to the same or analogous elements.

DESCRIPTION OF THE INVENTION

The characteristics, features and advantages of the present invention will become apparent from the following description, taken in conjunction with the accompanying drawings, which illustrate, by way of example only, the principles of the invention. This description is given for the sake of example only, without limiting the scope of the invention. The reference figures quoted below refer to the attached drawings.

It is to be noticed that the term "comprising", used in the claims, should not be interpreted as being restricted to the means listed thereafter; it does not exclude other elements or steps. It is thus to be interpreted as specifying the presence of the stated features, integers, steps or components as referred to, but does not preclude the presence or addition of one or more other features, integers, steps or components, or groups thereof. Thus, the scope of the expression "a device comprising means A and B" should not be limited to devices consisting only of components A and B. It means that with respect to the present invention, the only relevant components of the device are A and B.

Figure 1:
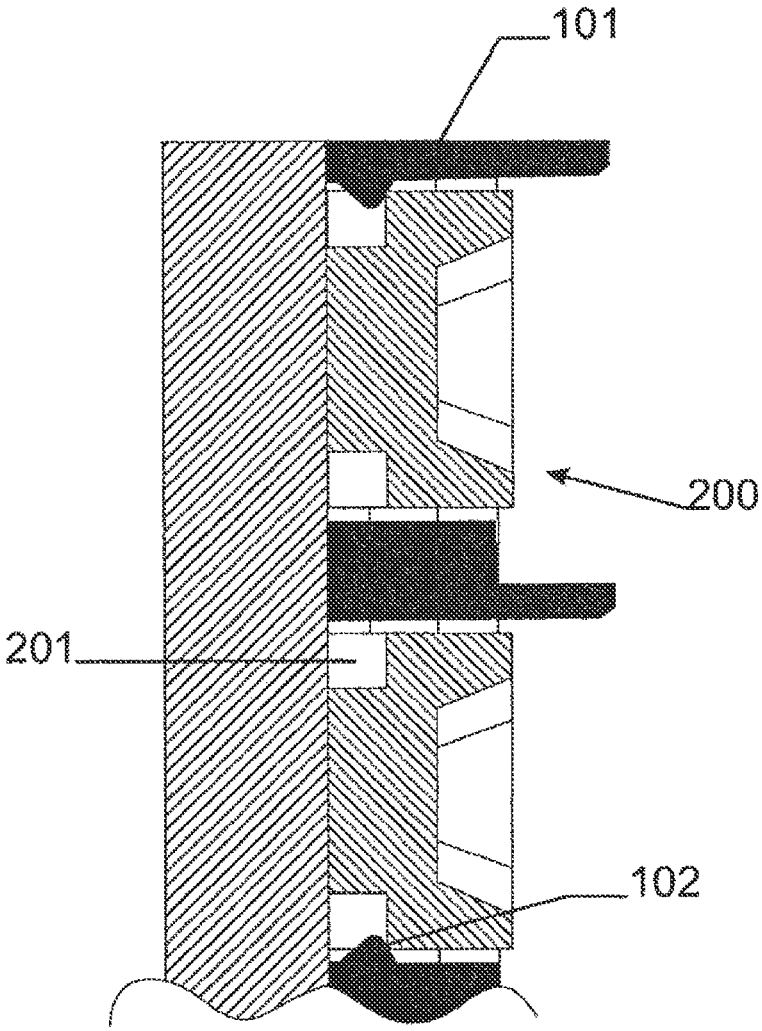
FIG. 1 illustrates a vertical cross-sectional view of part of the display system comprising two light source units and part of shading device fixed to the display board.
Figure 2:
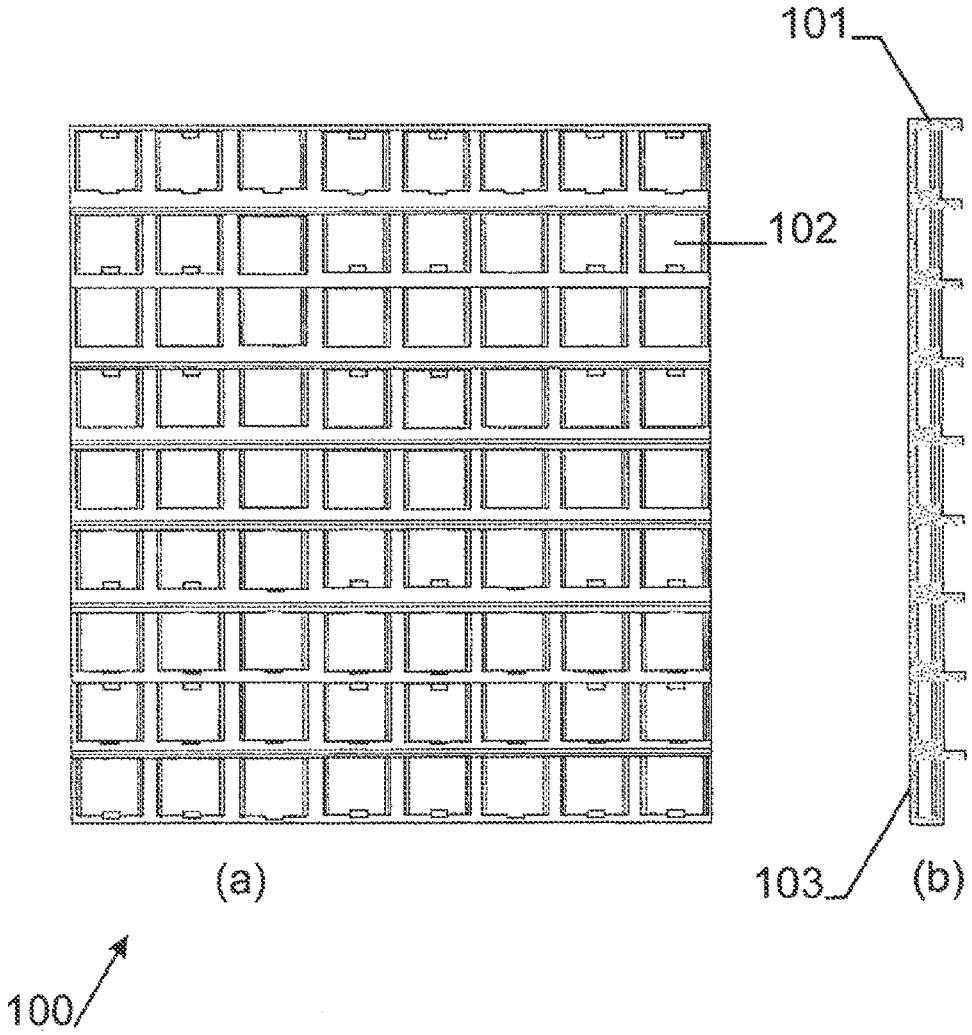
FIG. 2(*a*) illustrates a front view of the shading device.
Figure 3:
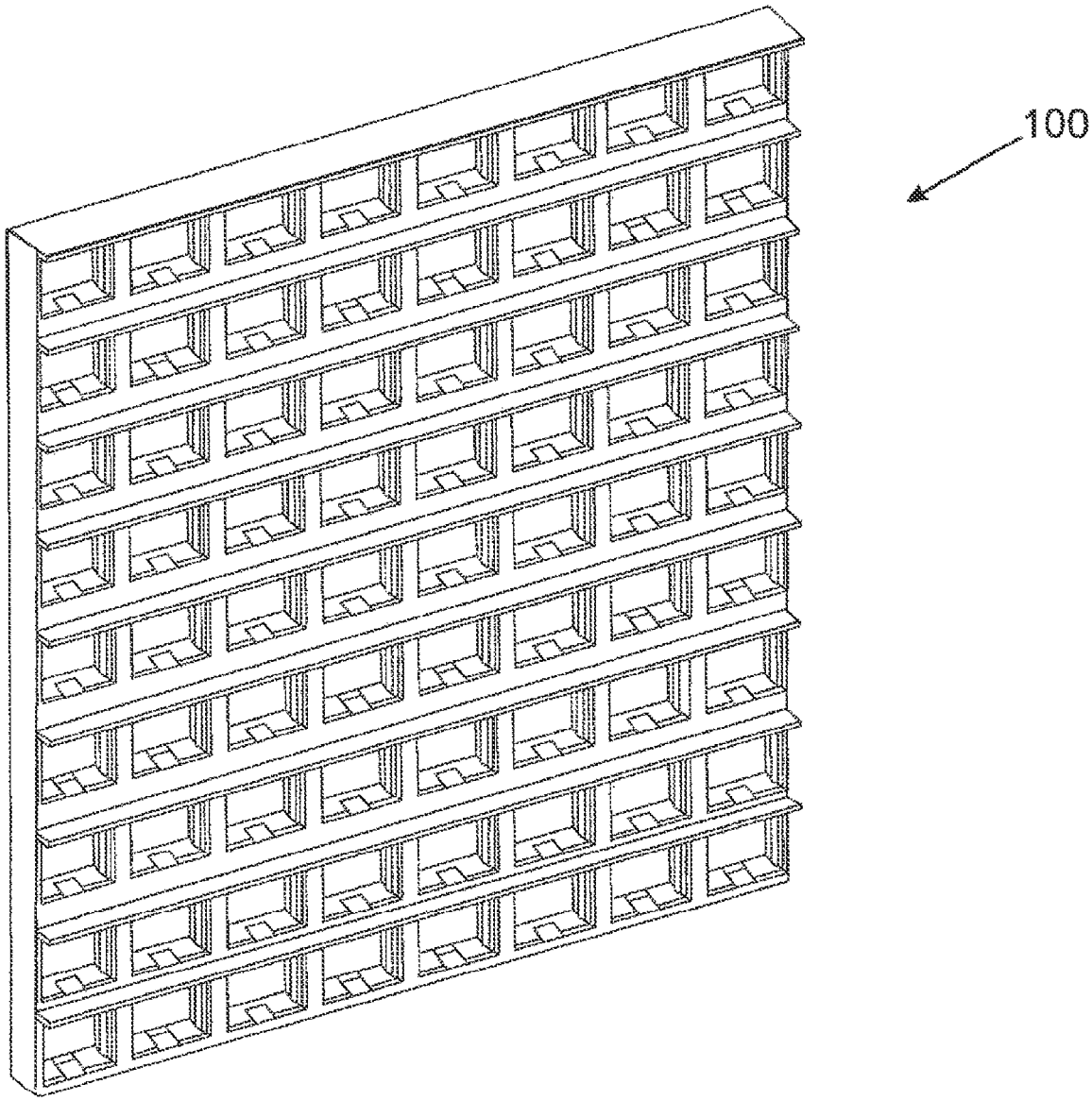
FIG. 3 illustrates an isometric view of the front side of the shading device.

In a first aspect, the present invention relates to a shading device for shading a display system. By way of example, the present invention not limited thereto, an exemplary embodiment of a shading device according to the first aspect is shown with reference to FIGS. 1 to 3. The shading device 100 is suitable for use with a display system comprising a plurality of light source units 200, such as e.g. encapsulated light emitting diodes (LED), but not limited thereto. The shading device 100 comprises a plurality of louvers 101 or shading elements 101, e.g. for shading light sources or light source units 200 of the display system from incident angled light, i.e. light hitting the display system under predetermined angles, or from cross-talk from neighbouring light source. The shading device 100 according to the present aspect furthermore comprises at least two fixing elements 102, also referred to as fixing means, for fixing the shading device 100 to the light source units 200 mounted in the display system. The fixing elements 102 may be mechanical fixing elements, although the invention is not limited thereto and the fixing elements also may be adapted for fixing to the display system using any other suitable force, such as e.g. based on magnetic interaction. The fixing may be removably fixing, i.e. the fixing may be such that the shading device 100 can, after fixing, be removed or released without damaging or destroying the display system. The latter is advantageous e.g. when part of the shading device 100 is broken and needs to be replaced or for maintenance of the display system, etc. The fixing elements 102 may be adapted for fixing in any suitable way, e.g. by fixing, clipping or cooperating, e.g. by virtue of their shape, with fixing features present at the light source units 200. The fixing elements may comprise a part that has substantially a complementary shape of a fixing feature on the display element or a light source unit thereof such that the fixing element and the fixing feature engage for providing a fixture between the display element and the shading device. The fixing elements may be adapted to cooperate with fixing features on the display system, e.g. on light source units on the display system. Such light source units may be mounted on the display system. The fixing elements may be adapted to cooperate with fixing features on the packaging of the light source units on the display system for fixing the shading device to the display system by laterally engaging, e.g., recesses, cavities, or slots in the side walls of the packagings of the light source units. The fixing features may for example be provided on the encapsulation of the light sources in the light source units 200. In FIG. 1, an example is provided, the invention not limited thereby, whereby the fixing elements of the shading device comprise a projecting part or protrusion that fit by virtue of their shape and position in recesses or slots along side walls of the light source units 200 to laterally engage the side walls of the packagings of the light source units, in the present example in the encapsulation for the light sources and being part of the light source units 200. The fixing elements 102 may be present at a frame 103 connecting or built up from the louvers or shading elements 101. The fixing elements may be present at a basis of such a frame 103. The at least two fixing elements 102 may be at least three fixing elements 102. The number of fixing elements 102 may be for example at least 10%, at least 25%, at least 33% or at least 50% of the number of light source units 200. The fixing elements 102 may be spread over the shading device. The spreading may be substantially uniform over the shading device. In this way the fixing may occur not only at the edge of the display system but also substantially uniformly spread over the display system, i.e. spread over a plane parallel to the imaging plane of the display system. The louvers of the shading device may be comprised in or may be connected by a frame and the fixing elements may protrude from the frame or from a basis of such a frame. The fixing elements may be adapted for fixing to a light source package, e.g. light emitting diode package, e.g. to an encapsulation means being part of the light source unit 200 and adapted for encapsulating a light source of the light source unit 200. Whereas FIG. 1 illustrates a detailed view of an exemplary display system whereon a shading device is fixed, FIG. 2 illustrates a front view (a) and side view (b) of an exemplary shading device. FIG. 3 shows an elevated top view of such a shading device 101. The fixing elements also may be or comprise hook shaped pins or extensions. The fixing elements also may be pins with a local variation in thickness for clicking or clipping in cavities. When magnetic force is used for fixing, the fixing elements also may comprise metal or magnetic means for magnetically interacting with fixing features on the display system. Whereas the fixing elements above are mainly described as protrusions, extensions, pins etc. for engaging in receiving parts such as recesses, cavities or slots formed or constituted along side walls of the packagings of the light source units, e.g., the fixing features on the display system, the fixing elements may also be receiving parts such as e.g. recesses, cavities or slots adapted for receiving pins, protrusions or extensions formed by or part of the fixing elements on the display system, e.g. by the light source units, e.g. by packaging of light sources being part of the light source units.

In a second aspect, the present invention relates to a light source unit for mounting in a display system. The light source unit 200 comprises a light source and a packaging, wherein the packaging is provided with a fixing feature adapted for fixing to a shading device for shading the display system. The light source unit 200 is especially suitable for display systems whereon a shading device according to the first aspect is to be fixed. The fixing feature of the light source unit 200 may be adapted for co-operating with one or more fixing elements 102 thus allowing fixing of the display system to the shading device 100 by virtue of their shape. The fixing feature(s) may comprise at least one slot, a recess or a cavity 201 for engaging with a fixing element 102 of the shading device 100. The latter is by way of example illustrated in FIG. 1. Other fixing features also may be used. When a magnetic force is used as fixing force, the packaging may be provided with a metal and/or magnetic material such that a magnetic interaction with fixing elements of the shading device can allow fixing. Further features and advantages may be as set out for or resulting from the shading device as described in the first aspect.

In a third aspect, the present invention relates to a display system comprising at least one light source unit as described in the second aspect or to a display system suitable for receiving a shading element as described in the first aspect. The display system furthermore may comprise a shading device as described in the first aspect. Features and advantages as described in the first and second aspect may be present for the display system according to the present aspect.

In a fourth aspect, the present invention also relates to a method for manufacturing a display system. Such a method comprises obtaining a display system with a plurality of light source units. Such obtaining may be constructing such a device, including e.g. mounting light sources as described in the second aspect in the display system, or it may be obtaining a pre-made display system. The method also comprises obtaining a shading device comprising at least two fixing elements for fixing to the display system. Again such obtaining may comprise manufacturing such a shading device or obtaining a pre-made shading device. According to the present aspect, the method also comprises fixing the shading device onto the display system by inserting the plurality of light source units through holes of the shading device and by fixing the fixing elements to at least one of the plurality of light source units. The fixing may comprise engaging mechanical fixing elements of the shading device with fixing features of the light source units. This may comprise engaging the fixing elements and the fixing features by engaging pins, protrusions or extensions in slots, recesses or cavities along side walls of the respective packagings of the light source units. Other features and/or advantages may be as set out for or as can be derived from features and advantages provided for the first, second or third aspect

The invention claimed is:

1. A shading device for shading a display system including a plurality of light source units arranged in a pattern, the light source units including respective light source packagings and being mounted so the light source units are exposed for display, the shading device comprising:

a shading element assembly comprising a plurality of shading elements and an opening associated with each shading element, said shading elements and associated openings connected together as a unitary framework and arranged in a pattern corresponding to the pattern of the plurality of light source units, with said openings in the framework arranged to accommodate each light source unit so each light source unit may extend through a respective opening of the framework when the framework is connected to the selected packagings;

said shading elements each arranged to individually shade a single light source unit of the display system extending through a respective opening of the framework from incident angled light when the shading assembly is located with the light source units extending through the associated openings of the framework;

at least two fixing elements connected to the framework configured to enable fixing of the framework to respective packagings of the light source units so that each light source unit that extends through a respective opening of the framework with its associated shading element is shielded by the shading element from incident angled light, wherein the fixing elements are removable fixing elements configured to be clipped or clicked to the packaging of the light source units of the display system, the fixing elements being such that the shading device is removable or releasable without damaging or destroying the display system.

2. The shading device according to claim 1, wherein the fixing elements comprise mechanical fixing elements.

3. The shading device according to claim 1, wherein the fixing elements comprise at least three fixing elements.

4. The shading device according to claim 1, wherein the fixing elements are distributed uniformly over the framework.

5. The shading device according to claim 1, wherein the fixing elements are configured to be fixed to an encapsulation device of the light source of the light source unit.

6. A light source unit for use in a display system, the light source unit comprising a light source and a packaging for the light source, wherein the packaging is provided with fixing feature arranged to cooperate with a fixing element of the shading device as recited in claim 1.

7. The light source unit according to claim 6, wherein the fixing feature comprises at least one slot, recess or cavity.

8. A display system comprising light source units as recited in claim 6 and a shading device as recited in claim 1 affixed to fixing features of respective light source packagings by said fixing elements.

9. The shading device according to claim 1, wherein the number of fixing elements is no more than 50% of the number of the plurality of light source units.

10. The shading device according to claim 1, wherein the at least two fixing elements are configured to laterally engage side walls of the respective packagings of the light source units.

11. The shading device according to claim 1, wherein only one of the at least two fixing elements is connected to one of the plurality of shading elements and only a second one of the at least two fixing elements is connected to a different one of the plurality of shading elements.

12. A method for manufacturing a display system, comprising:

providing a display system comprising a plurality of light source units supported in a pattern, with the light source units including respective light source packagings and being mounted so the light source units are exposed for display;

providing a shading device comprising a framework of connected shading elements and associated openings arranged in a pattern corresponding to the pattern of the light source units;

fixing the shading device onto the display system so that the plurality of light source units extend through said openings of the shading device and by fixing at least two fixing elements of the shading device to respective packagings of the plurality of light source units so that the shading devices shade the light source units from incident angled light, wherein the fixing elements are removable fixing elements configured to be clipped or clicked to the packaging of the light source units of the display system, the fixing elements being such that the shading device is removable or releasable without damaging or destroying the display system.

13. The method according to claim 12, wherein the step of fixing the at least two fixing elements to the at least one of the plurality of light source units comprises engaging mechanical fixing elements of the shading device with a slot, recess or cavity provided in the packaging of respective light source units.

14. The method according to claim 12, wherein the number of fixing elements is no more than 50% of the number of the plurality of light source units.

15. The method according to claim 12, wherein the at least two fixing elements are configured to laterally engage side walls of the respective packagings of the light source units.

16. The method according to claim 12, wherein only one of the at least two fixing elements is connected to one of the plurality of shading elements and only a second one of the at least two fixing elements is connected to a different one of the plurality of shading elements.

* * * * *

UNITED STATES PATENT AND TRADEMARK OFFICE

CERTIFICATE OF CORRECTION

PATENT NO. : 9,202,394 B2
APPLICATION NO. : 12/664915
DATED : December 1, 2015
INVENTOR(S) : Karim Meersman It is certified that error appears in the above-identified patent and that said Letters Patent is hereby corrected as shown below:

On the title page item (73),

Delete "Kortruk" and replace with --Kortrijk--

Signed and Sealed this
Twenty-ninth Day of March, 2016

Michelle K. Lee

Michelle K. Lee
*Director of the United States Patent and Trademark Office*